United States Patent [19]

Meyer et al.

[11] 4,068,974

[45] Jan. 17, 1978

[54] FOUNTAIN TOOTHBRUSH HAVING BRISTLE CARRIER EASILY PRODUCIBLE BY INJECTION MOLDING

[75] Inventors: Walter Meyer; Anton Bará, both of Triengen, Switzerland

[73] Assignee: Trisa Burstenfabrik AG Triengen, Triengen, Switzerland

[21] Appl. No.: 704,939

[22] Filed: July 13, 1976

[30] Foreign Application Priority Data

June 8, 1976 Switzerland ..... 7184/76

[51] Int. Cl.[2] ..... A46B 11/00

[52] U.S. Cl. ..... 401/150; 401/135; 401/151; 401/180; 222/325

[58] Field of Search ..... 401/44, 45, 132–135, 401/146, 150, 151, 149, 176, 177, 178, 190, 286; 222/162, 162 X, 251, 321, 325, 478, 482, 485

[56] References Cited

U.S. PATENT DOCUMENTS

| | | | |
|---|---|---|---|
| 2,323,378 | 7/1943 | Champion et al. | 401/150 |
| 3,118,166 | 1/1964 | Bell | 401/150 |
| 3,910,706 | 10/1975 | Del Bon | 401/134 |

*Primary Examiner*—Stephen C. Pellegrino
*Assistant Examiner*—Jerome D. Stremcha
*Attorney, Agent, or Firm*—Werner W. Kleeman

[57] ABSTRACT

A fountain toothbrush is described which comprises a bristle carrier having bristles, a handle containing a reservoir for liquid or pasty dentifrice, a duct leading from the reservoir to the bristles, and actuating means which urge the reservoir in a direction out of the handle. A piston has a passage connected to the duct and to the interior of the reservoir and a cylinder sleeve part is provided on the reservoir into which the piston protrudes. When the piston is pushed into the sleeve part towards the reservoir, dentifrice is conveyed onto the bristles. To achieve a hermetic sealing and simultaneously a more exact dosage of the dentifrice, the piston further comprises a valve body which is displaceable relative to the piston and adapted for obturating, toward the end of each stroke of the piston into the sleeve part of the reservoir, an opening connecting the interior of the reservoir with the interior of the sleeve part, and frees this opening again when the piston and the sleeve part are displaced away from one another.

6 Claims, 7 Drawing Figures

Fig. 1
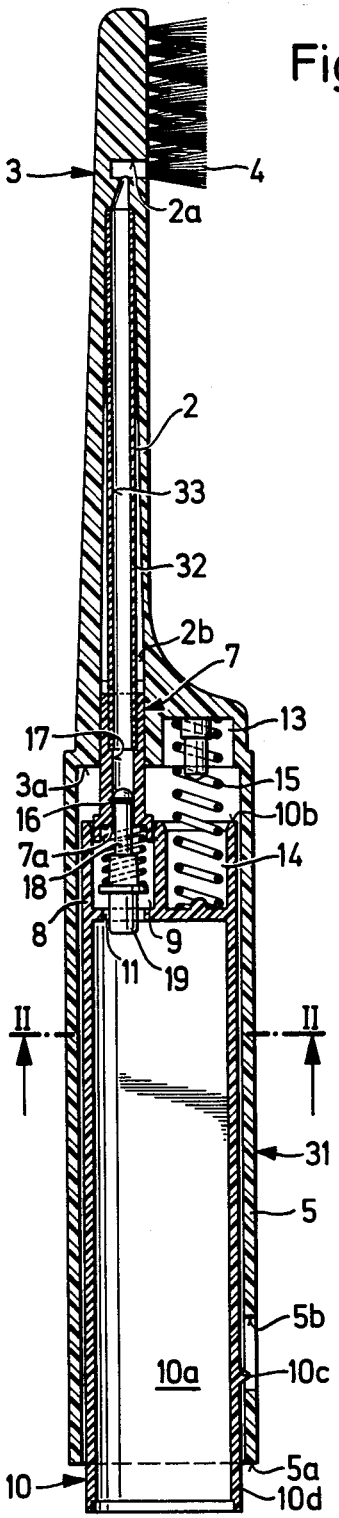
Fig. 2
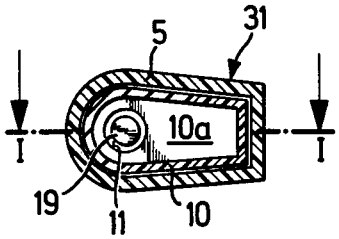
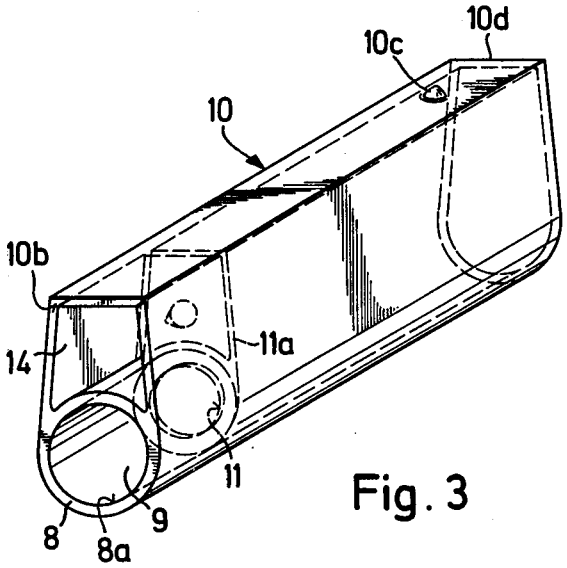
Fig. 3

FOUNTAIN TOOTHBRUSH HAVING BRISTLE CARRIER EASILY PRODUCIBLE BY INJECTION MOLDING

BACKGROUND OF THE INVENTION

This invention relates to a fountain toothbrush or brush comprising a bristle carrier, a set of bristles on said carrier near one end thereof, a rigid handle containing a reservoir for liquid or pasty dentifrice, a duct leading from the reservoir through the bristle carrier to the set of bristles, actuating means facing toward the reservoir and comprising a spring member which urges the reservoir in a direction out of the handle, and a piston which is borne by the bristle carrier at its end facing away from the bristles, and being firmly connected thereto, and which has a passage connected to the said duct and to the interior of the reservoir, and protrudes into a cylinder sleeve part provided on the reservoir to be displaceable and sealingly guided in the said sleeve part in unactuated or in an actuated position, whereby, when the piston is pushed into the sleeve part in the direction towards the reservoir, dentifrice or other material to be dispensed is conveyed through the piston passage and the duct, onto the bristles, and wherein the reservoir is inserted axially displaceably into the handle so that it protrudes with its outer end out of the handle, the latter being open at its end away from the bristle carrier, and wherein the reservoir can be displaced into the handle for conveying dentifrice onto the bristles.

A fountain toothbrush of this type has been described in U.S. Patent No. 3,937,582. However, when manufacturing this bristle carrier by using modern production methods, it is difficult to ensure that the outflow of dentifrice during the non-use of the toothbrush is completely prevented e.g. when the latter is held with the bristles pointing downwards.

OBJECT AND SUMMARY OF THE INVENTION

Therefore an object of the invention is to improve this known fountain toothbrush during its manufacture by modern mass-production methods, e.g. from thermoplastic resin material by injection molding techniques, so a better, preferably complete, sealing against unwanted outflow of dentrifrice is achieved even when the non-actuated fountain toothbrush is held with its bristle set pointing downwards.

This object is attained according to the invention by a fountain toothbrush of the type initially described, comprising a piston bearing at its end facing towards the set of bristles a conduit member having at least one through-passage and which is firmly inserted in the duct (mentioned hereinbefore) of the bristle carrier, the cross-sectional area of this duct may widen towards the reservoir.

The conduit member can have a single central, axial canal and can be inserted in the duct of the bristle carrier, with the outer wall of the conduit member being in sealing engagement with the inner wall of the said duct.

Alternatively, the conduit member can have at least one and preferably several axially extending grooves in its outer, preferably cylindrical wall and can be partly inserted into the duct of the bristle carrier in the same manner as described above, whereby each groove, together with the inner wall of the carrier duct covering it, forms an axially extending through-passage between conduit member and bristle carrier. For instance, four axially extending passages can thus be provided symmetrically about the outer wall of the conduit member.

Furthermore, to achieve a hermetic sealing and simultaneously a more exact dosage of the dentrifrice, the piston can carry, at its end facing the reservoir, a sealing element which is permanently in sealing engagement with the inner wall of the sleeve part and, in the central passage through the piston, a valve body can be housed which is displaceable, relative to the piston, and which will obturate, toward the end of the stroke of the piston into the sleeve part, an opening connecting the interior of the reservoir with the interior of the sleeve part and which will free this opening again when the piston and the sleeve part are displaced away from one another, i.e. the piston is moved away from the reservoir.

Preferably, the valve body is spring-loaded relative to the piston, to allow movement out of the piston passage.

The passage in the piston can also be provided with a restriction serving as a valve seat which latter is sealingly engaged by the valve body during movement of the reservoir away from the piston, while the valve body frees the valve seat when the piston and the reservoir are displaced toward each other, thereby establishing free communication between the interior of the sleeve part upstream of the frontal face of the piston and the canal or canals of the conduit member.

The invention will be better understood, and further objects and advantages will become apparent from the ensuing detailed specification of preferred by merely exemplary embodiments taken in conjunction with the drawings.

BRIEF DESCRIPTION OF THE DRAWINGS

FIG. 1 shows an axial sectional view of a preferred embodiment of the fountain toothbrush according to the invention, with a bristle carrier having a handle and a replaceable cartridge not integral therewith and serving as a reservoir;

FIG. 2 shows a cross-sectional view of the cartridge and the guide sleeve surrounding it shown in FIG. 1 taken along line II—II in FIG. 1;

FIG. 3 shows a perspective view of the cartridge shown in FIG. 1;

DETAILED DESCRIPTION OF THE DRAWINGS

Figure 4:
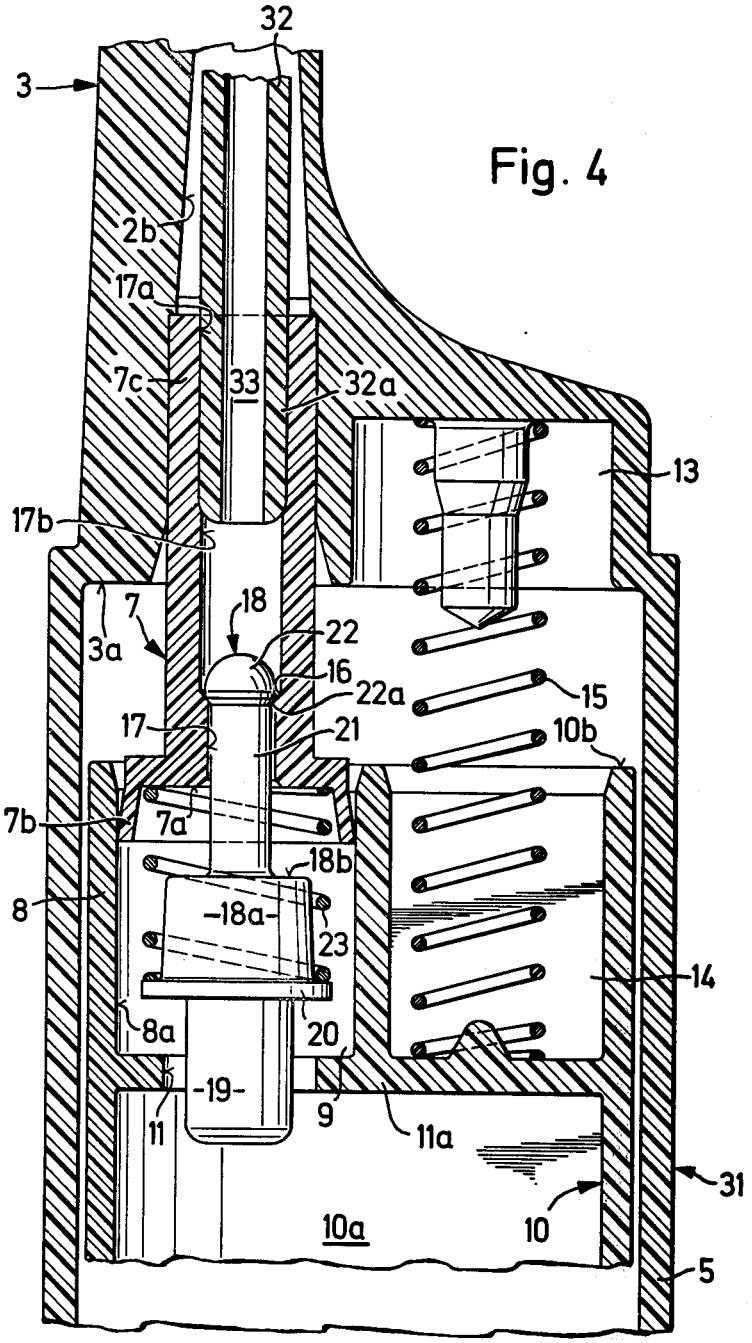
FIG. 4 shows an axial sectional enlarged view of the zone of the toothbrush in which the bristle carrier and the cartridge engage one another, wherein the cartridge is in a position in which it protrudes from the open end of the handle part of the bristle carrier.

The fountain toothbrush shown in FIGS. 1 and 2 comprises as main parts a bristle carrier 3 carrying a set of bristles 4 on one end, considered as its "forward" end, while about the face 3*a* of its opposite or "rear" end facing away from its bristle-carrying end the bristle carrier 3 has an extension in form of a rigid-walled sleeve part or hull 5 which serves as a handle and is open at its rear end 5*a*. Through this open handle end 5a, there is inserted a cartridge 10 containing liquid or pasty dentifrice. A duct 2 extends through the bristle carrier 3 from the rear end face 3a of the latter to the bristle-carrying end of the same and opens into a lateral outlet duct 2a between the bristles 4. Preferably the diameter of the liquid flowpath leading through duct 2 should, at one point, be sufficiently narrow to exert a capillary effect on the dentifrice flowing therethrough depending on the viscosity of the latter. Thereby unintentional flow of dentifrice out of the outlet duct 2a is prevented in non-actuating position, even when the fountain toothbrush is held within the bristles 4 pointing downwards and is shaken or flung about.

A piston 7 having an axial passage 17 is pressed with a tight fit into the widened end region 2b of duct 2, which opens in frontal face 3a of the bristle carrier 3. The dentifrice-containing cartridge 10 is inserted in handle 5 on the bristle carrier 3 and bears a cylinder sleeve part 8 at its end face 10b directed into the interior of handler or hull 5. The chamber 9 in sleeve part 8 is in free communication with the hollow interior 10a of the cartridge 10 by an opening 11. Sleeve part 8 is arranged in the inner end wall 10b of cartridge 10 to register with the piston 7 and the internal width of sleeve part 8 is such that a sealing element 7b borne by piston 7 at its frontal face 7a can be introduced thereinto and can be sealingly displaced in sleeve part 8, the latter and the piston constituting together a small pump. Prior to its insertion into handle 5, a new, dentifrice-filled cartridge 10 is sealed by a membrane (not shown) across opening 11, which membrane is ruptured during introduction of the cartridge 10 into the handle 5. Insertion is limited by a nose 10c provided on the outer cartridge wall and being snapped into a groove or recess 5b extending axially in the sidewall of handle 5, by abutment of nose 10c against that transverse end wall of groove 5b which is located forward, i.e. in the direction towards the bristles 4.

A recess 13 provided in a part of the rear end wall 3a of bristle carrier 3 spaced from piston 7 and another recess 14 is provided, spaced from sleeve part 8, in the opposite frontal wall 10b of cartridge 10 facing toward the bristles 4 are aligned with one another and receive therein, respectively, the opposite ends of a compression spring 15 which serves as a return spring for urging bristle carrier 3 and cartridge 10 asunder. The displacement of cartridge 10, due to the action of spring 15, outwardly of the open rear end of handle 5 is limited by the abutment of nose 10c of cartridge 10 against the transverse rear end wall of groove 5b. Cartridge 10 is thus prevented from dropping out of handle 5. However, when pulling more strongly on the rear end of cartridge 10 protruding from the open end of handle 5, the somewhat flexible nose 10c can be forced to slip out of groove 5b, so an empty cartridge can be removed from handle 5 and be replaced by a new, full cartridge. Instead of providing a resilient nose 10c, a sufficient resiliency of the wall of cartridge 10 which is especially in the vicinity of nose 10c will serve the same purpose.

If instead of groove 5b a window is provided as shown in FIG. 1 nose 10c can be pressed slightly inwardly e.g. with a fingertip, and at the same time be dislodged from groove 5b by simply pushing it outwardly, whereupon the cartridge 10 can be easily pulled out of handle 5. For this purpose, window 5b can also be located nearer the other, forward end of handle 5, e.g. towards its middle zone. A pin 19 projecting outwards from the end face 7a of piston 7 opposite cartridge 10 serves to rupture the cartridge membrane mentioned hereinbefore when cartridge 10 is inserted far enough into handle 5. Preferably, this occurs at the same instant as nose 10c snaps into groove or window 5b, or shortly beforehand.

Figure 5:
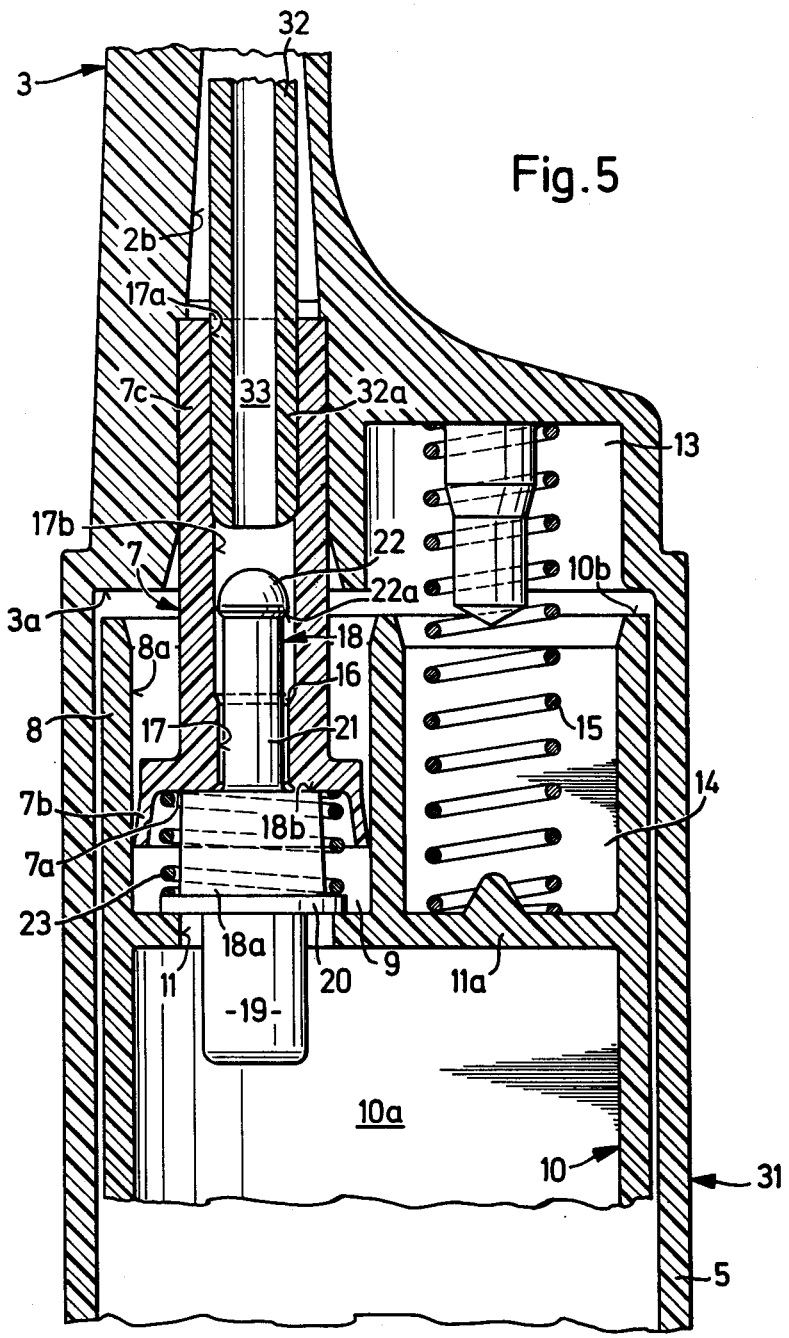
FIG. 5 shows a similar axial sectional view as FIG. 4, but with the cartridge urged into the handle part of the bristle carrier.

In the manufacture of bristle carrier 3 bearing handle 5 integral therewith, by injection molding, providing the narrow, long duct 2 therein is rendered difficult, because the necessary long, thin core needle will break easily or be bent. Duct 2 must therefore be manufactured of a larger diameter than is desirable for a controlled outflow of dentifrice. In contrast thereto, conduit member 32, which is preferably in form of a hollow needle having a narrow axial canal 33 therethrough, can be firmly inserted in the wider duct 2 (FIGS. 4 and 5). The open forward end portion 7c of piston 7 is drawn over the end portion 32a of conduit 32 and is seated tightly in, or is firmly connected in some other manner, to the widened zone 2b of duct 2 which is provided in the vicinity of bristle carrier end face 3a and opens in the latter.

The sealing element in the embodiment shown is constituted by a circumferential elastic sealing rim 7b provided on piston 7 about the frontal face 7a of the latter facing toward cartridge 10; it engages sealingly and displaceably the inner wall 8a of cylinder chamber 9 in sleeve part 8.

Axial piston passage 17 through piston 7 opens at one end in the center of frontal piston face 7a and a conically bevelled ring shoulder 16 is provided in the middle zone thereof, serving as a valve seat which merges with passage zone 17b of wider diameter which latter zone extends from ring shoulder 16 to passage opening 17a facing toward bristles 4.

A valve body 18 constituting part of a pair of oppositely working valves is housed in piston passage 17 and comprises a sealing portion 18a of larger diameter bearing an abutting disk or gasket 20 which is adapted to rest sealingly against the inside of a transverse wall 11b which separates the interior of chamber 9 from the interior 10 of the reservoir in cartridge 10, thus obturating the opening 11 which is located in this transverse wall. Abutting disk 20 bears the pin 19 which protrudes through opening 11 into the interior 10a of cartridge 10. The diameter of pin 19 is slightly smaller than that of opening 11.

The annular underside face 18b of sealing portion 18a of valve body 18, facing towards the bristles 4 can be brought to bear against the frontal wall 7a of piston 7 and a valve stem 21 protrudes from underside 18b into piston passage 17 and extends beyond valve seat 16 in the direction of bristles 4; valve stem 21 bears at its free end a wider diameter head portion 22, the underside of which facing away from the free valve stem end is provided with a preferably conically bevelled annular valve sealing face 22a. The latter is devised to engage valve seat 16 with a hermetic seal.

The distance between the face of abutting disk 20, destined to obturate opening 11, from the valve sealing face 22a of head part 22 of the valve body 18, and the distance between the frontal piston face 7a and valve seat 16, are dimensioned so, when piston 7 abuts sealingly with its frontal face 7a on the underside 18b of annular sealing portion 18a and, when the outer face of abutting disk 20 comes to rest on transverse wall 11a of sleeve part 8 containing opening 11, valve head part 22 is lifted from valve seat 16. This will occur against the force of a valve resetting spring 23 which is lodged between the underside of abutting disk 20 facing toward piston 7 and the frontal face 7*a* of the piston and urges valve head part 22 into sealing engagement with valve seat 16.

Figure 6:
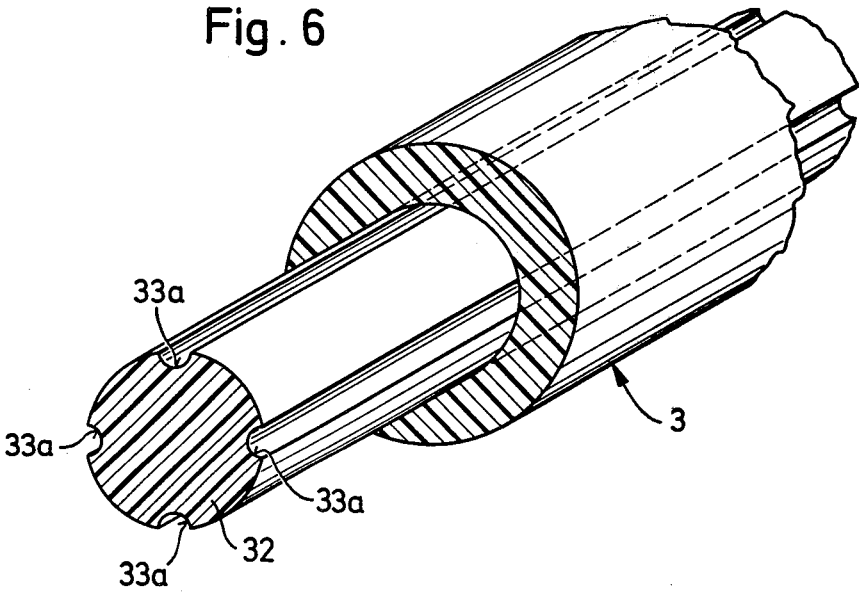
FIG. 6 shows a perspective, partial view of another embodiment of the conduit member provided in the bristle carrier.
Figure 7:
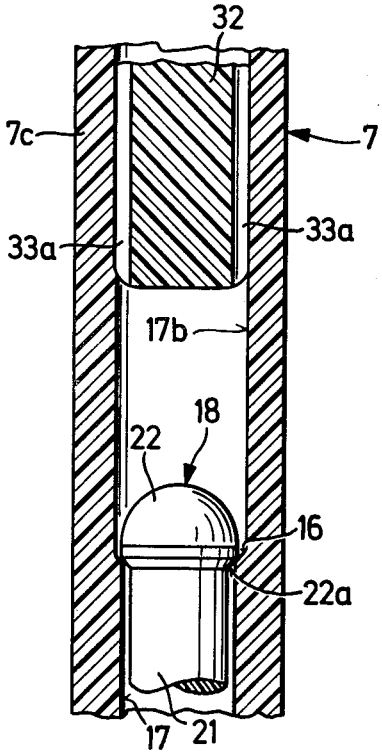
FIG. 7 shows in axial sectional view a part of the piston having inserted therein a part of the embodiment of a conduit element as shown in FIG. 6.

In lieu of a single channel 33 the conduit member 32 may also be provided in it's outer wall with one, two or more, e.g. four longitudinal grooves 33*a* as shown in FIGS. 6 and 7. These longitudinal grooves 33*a* are covered by the inner wall of passage 17 in the open end region 7*c* of piston 7 and downstream thereof by the inner wall of duct 2 in bristle carrier 3, thus forming a plurality of channels whose individual cross-sectional areas can be held so small by providing correspondingly flatter or narrower cross-sections of grooves 33*a*, that they may exercise any desired capillary effect on the liquid dentifrice.

The fountain toothbrush is used in practice in the following manner:

The cartridge 10 is first introduced into handle 5 and the membrane covering its opening 11 is pierced by means of pin 19 which is held in position owing to the abutment of sealing part 18*a* of the valve body 18 against the piston frontal wall 7*a*. The bristle carrier 3 and cartridge 10 thus assume the positions relative to one another which are shown in FIG. 5. In this position abutting disk 20 of the first valve structure obturates opening 11 being already urged against the transverse wall 11*a* defining its valve seat surrounding the opening by a compressed valve spring 23 shortly before the position of FIG. 5 is reached.

Now, when the finger depressing cartridge 10 is removed, the strong resetting spring 15 will move cartridge 10 in handle 5 away from the rear end face 3*a* of bristle carrier 3, thereby also moving cartridge 10 and its opening 11 away from piston 7, the sealing collar 7*b* of which remains, however, in sealing engagement with the inner wall 8*a* of chamber 9 in sleeve part 8 until the position of FIG. 4 is reached. During this movement the abutting disk 20 will initially hold opening 11 closed for a short time as spring 23 will not be completely untensioned even while valve body head part 22 has already come to rest on valve seat 16.

Thereby a reduced pressure is produced in the pumping space surrounded by wall 8*a* of chamber 9, which chamber serves as the cylinder of piston 7. As resetting spring 15 moves cartridge 10 further outwardly relative to handle 5 and, as valve body 18 is held with its annular valve sealing face 22*a* of the second valve structure on valve seat 16, abutting disk 20 will free opening 11. Thereby, when the toothbrush is held with bristles 4 downward, liquid dentifrice will be suctioned into the pumping space of chamber 9. Any residual air in the pumping space will rise in the form of bubbles to the outer, upper end of cartridge 10 (FIG. 4).

When finger pressure is again exerted on the protruding rear end 10*c* of cartridge 10 the piston 7 is again transferred to the position relative to sleeve part 8 which is shown in FIG. 5. Thereby, opening 11 is first closed by abutment of abutting disk 20 thereagainst, whereafter, in the course of further movement of the cartridge and piston toward each other, spring 23 is compressed and valve seat 16 is moved away from valve body head part 22, whereby the latter is moved into the wider diameter region 17*b* of piston passage 17, and with further advancement of piston 7 into the pumping space of chamber 9, liquid dentifrice from the latter is pressed past valve seat 16 and valve body head part 22 into canal 33 until the frontal piston wall 7*a* abuts against the annular underside face 18*b* of valve body sealing part 18*a*.

When the cartridge is again released, sleeve part 8 and piston 7 will return from their relative position shown in FIG. 5 to that shown in FIG. 4, and the fountain toothbrush is again ready for the discharge of a new dose of liquid dentifrice or other medium to be dispensed onto the bristles 4 or other portion of the carrier 3 from where such medium is to be dispensed.

An effective obturation of opening 11 in cartridge 10 is of primary importance for the safe functioning of the fountain toothbrush according to the invention, and in particular for an exact dosification of the release of dentifrice therefrom. This requires a sufficiently strong spring 23 and a sufficiently narrow interspace between valve stem 21 and the inner wall 17*b* of piston passage 17.

A fountain toothbrush having a piston part introducible into a rigid-walled, rearwardly closed reservoir and a valve mounted in the frontal wall of the piston part has been described in U.S. Pat. No. 3,227,165 to COSTANZA, however, in this known fountain toothbrush, the valve consists of a rubber membrane having a slit therein which will not permit a dosified release of liquid dentifrice onto the bristles. Moreover, this fountain toothbrush would be difficult to manufacture using modern injection molding techniques.

What is claimed is:

1. A fountain toothbrush comprising a bristle carrier, a set of bristles on said carrier near one end thereof, a rigid handle containing a reservoir for liquid or pasty dentifrice, a duct leading form the reservoir through the bristle carrier to the set of bristles, actuating means facing toward the reservoir and comprising a spring member which urges the reservoir in a direction out of the handle, and a piston which is borne by the bristle carrier at its end facing away from the bristles, and being firmly connected thereto, and which has a passage being connected to said duct and to the interior of said reservoir; and a cylinder sleeve part being provided on said reservoir into which said piston protrudes, being displaceable and sealingly guided in said sleeve part in unactuated, or in an actuated position, whereby, when the piston is pushed into the sleeve part in the direction towards the reservoir, dentifrice is conveyed through said piston passage and said duct onto the bristles, and wherein the reservoir is inserted axially displaceably into the handle so that it protrudes with its outer end out of the handle, the latter being open at its end away from the bristle carrier, and wherein the reservoir can be displaced into the handle for conveying dentifrice onto the bristles, said reservoir having an opening connecting the interior of the reservoir with the interior of said sleeve part, and wherein said piston carries, at its end facing toward said reservoir, a sealing element being permanently in sealing engagement with the inner wall of said sleeve part; said piston further comprising, housed in the passage therethrough, a valve body which is displaceable relative to the piston and containing means for obturating said opening toward the end of each stroke of the piston into said sleeve part, and freeing said opening again when the piston and the sleeve part are displaced away from one another.

2. A fountain toothbrush as described in claim 1, wherein said valve body is spring-loaded relative to said piston, in a direction out of said piston passage.

3. A fountain toothbrush as described in claim 1, wherein said passage in said piston has a restriction therein serving as a valve seat being adapted for sealing engagement by said valve body during movement of said reservoir away from said piston, while said valve body frees said valve seat when said piston and said reservoir are displaced toward each other, thereby establishing free communication between the interior of said sleeve part upstream of the frontal face of said piston and the duct leading to the set of bristles.

4. A brush for dispensing a dispensible medium, comprising:

carrier means for the brush;

said carrier means including a portion from which there is dispensed said medium;

a handle cooperating with the carrier means;

reservoir means located in said handle and containing the dispensible medium;

means for normally urging the reservoir means in a direction out of the handle;

a sleeve containing a chamber for the dispensible medium carried by said reservoir means;

flow means communicating the chamber of said sleeve with the reservoir means to permit movement of dispensible medium between the reservoir means and said chamber of the sleeve;

piston means movable within said sleeve;

said piston means having means providing a passage between the chamber of the sleeve and the carrier means for dispensing the dispensible medium in the direction of the medium dispensing portion of the carrier means;

valve means comprising a valve body forming at least part of first and second valve acting in opposite relationship to one another and cooperating with said piston means and said sleeve;

said first valve comprising a first valve structure cooperating with said sleeve for interrupting the flow of dispensible medium between the reservoir means and the chamber of the sleeve and said second valve comprising a second valve structure for permitting flow of dispensible medium from the chamber of the sleeve through said passage means towards the dispensing portion of the carrier means; and said reservoir means being displaceable into said handle for actuating said first valve structure to interrupt the flow of dispensible medium between said reservoir means and said chamber of said sleeve and for actuating said second valve structure to permit flow of the dispensible medium between said chamber of the sleeve and said passage means to allow dispensible medium to flow to said carrier means for dispensement from said dispensing portion thereof.

5. The brush as defined in claim 4, wherein:

said sleeve includes means defining a valve seat for said first valve structure;

said passage means of said piston means including means defining a valve seat for said second valve structure.

6. The brush as defined in claim 5, wherein:

displacement of said reservoir means into said handle causes relative movement between said valve seat of the first valve structure and said valve body for providing a flow communication between said reservoir and said chamber of said sleeve and likewise causes relative movement between said valve seat of said second valve structure and said valve body for opening said second valve structure to permit flow of the dispensible medium between the chamber of the sleeve and said dispensing portion of said carrier means.

* * * * *